US007077711B1

(12) United States Patent
Moore

(10) Patent No.: US 7,077,711 B1
(45) Date of Patent: Jul. 18, 2006

(54) CAM LOCK FOR ELECTRICAL TERMINAL

(75) Inventor: Daniel D. Moore, Canton, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/204,033

(22) Filed: Aug. 16, 2005

(51) Int. Cl.
*H01R 4/50* (2006.01)

(52) U.S. Cl. ..... 439/864; 439/773

(58) Field of Classification Search ..... 439/864, 439/883, 773, 754
See application file for complete search history.

(56) References Cited

U.S. PATENT DOCUMENTS

| | | | | |
|---|---|---|---|---|
| 2,196,327 | A | 4/1940 | Ryder | |
| 2,621,222 | A * | 12/1952 | Wirth | 429/96 |
| 2,663,854 | A | 12/1953 | Peterson | |
| 4,176,900 | A | 12/1979 | Hines et al. | |
| 4,983,086 | A * | 1/1991 | Hatrock | 411/259 |
| 5,269,709 | A * | 12/1993 | Eriksson | 439/772 |
| 5,389,466 | A | 2/1995 | Inoue et al. | |
| 5,486,434 | A * | 1/1996 | Aoyama | 429/178 |
| 6,019,647 | A * | 2/2000 | Trudel et al. | 439/864 |
| 6,079,998 | A | 6/2000 | Kamath | |
| 6,178,106 | B1 | 1/2001 | Umemoto et al. | |
| 6,203,383 | B1 | 3/2001 | Iby et al. | |

* cited by examiner

*Primary Examiner*—Tulsidas C. Patel
*Assistant Examiner*—Vladimir Imas
(74) *Attorney, Agent, or Firm*—Daniel R. Edelbrock

(57) ABSTRACT

A lever is attached to a power distribution module by a bracket. The lever has cam elements positioned over a conductor connected to the power distribution system within the module. The cam elements each have a rounded surface and an adjacent flat surface. The conductor is bowed away from a nonconductive supporting surface of the module. A locating pin extends from the nonconductive surface near the conductor. An eyelet terminal on the end of a power supply cable from a battery or alternator is placed over the locating pin to properly position the terminal between the cam elements and the bowed conductor. The lever is operated to rotate the cam elements. The rounded surfaces press the terminal down upon the bowed conductor, deflecting the conductor until the flat surfaces of the cam elements move into contact with the terminal and hold the lever in position. A secondary, releasable latch on the module secures the lever in a position fully connecting the terminal to the conductor.

17 Claims, 3 Drawing Sheets

CAM LOCK FOR ELECTRICAL TERMINAL

BACKGROUND OF THE INVENTION

1. Field of the Invention

This invention relates in general to a power supply connection to a vehicle power distribution box and more particularly to a lever-operated cam device for securing a terminated power supply cable in electrical connection with a power distribution system.

2. Discussion of Related Art

An electrical junction block or power distribution box (PDB) is commonly used in automotive vehicles to streamline electrical system wiring by eliminating multi-branch wiring. The PDB consolidates relays, fuses, connectors, branch circuits and other electrical components in a single location. This is typically done by incorporating one or more bus bars or similar conductors into a housing. The bus bars are used to supply and distribute electrical power to the components for serving the vehicle electrical circuit requirements. The electrical power is usually provided to the bus bars through a power supply line from the vehicle alternator and/or battery. FIG. 1 illustrates how the electrical connection is typically made. The PDB 10 is broadly represented and has a protruding ledge 12. An electrically conductive bus bar 14 rests on the ledge 12 and extends into the PDB 10 for electrical connection with other bus bars in an internal power distribution system. A flat eyelet terminal 16 on the end of a power supply line 18 is fit over a threaded bolt 20 attached to and protruding from the PDB ledge. A nut 22 with an associated washer 24 is used to tighten the terminal 16 down on the PDB into electrical contact with the bus bar 14 and the electrical distribution system. This method requires separate nut and washer components and a wrench to turn the nut on the bolt. The method also presents problems such as stripping of the bolt threads with repeated service, and possible under-tightening of the nut leading to a poor electrical connection.

It is known in the art to use a hand-operated lever rather than a nut and bolt, and associated wrench, to secure battery terminals to posts on a battery. For example, U.S. Pat. No. 5,389,466 discloses a battery terminal for connecting an electrical wire to a battery post. The terminal includes an annular portion for fitting around and engaging the post. The annular portion has an open free end formed by initially spaced apart tightening plates. A lever connected to the terminal has an operating arm extending from a cam-shaped bearing portion with a curved first side and a straight second side. When the operating arm of the lever is pivoted toward the annular portion, the first side of the bearing portion pushes one of the tightening plates toward the other, pressing or squeezing the annular portion around the battery post. When the straight second side of the bearing portion comes into contact with the tightening plate, the lever is securely held in the position pressing the annular portion around the post. In this device, the lever and annular portion are essentially in the same plane, providing an adequate device for tightening a terminal around a post. But this does not suggest a workable device for pressing a flat power supply terminal into electrical contact with a bus bar in a power distribution box.

In Japanese Patent Application Document No. 10-144367, published May 29, 1998, a seat part is formed on a battery post. A terminal metal fitting is fit over the post and rests against the seat part. A washer-like spring member is placed over the terminal metal fitting. A lever having a cam part is pivotally mounted on a bracket. The bracket has a hooking piece for attaching the bracket to the seat part. The bracket is installed on the seat part with the cam part of the lever positioned over the spring member. When the lever is pivoted, the cam part pushes on the spring member and forces the terminal against the seat part. This device requires a specially formed battery post and seat part, and separate components such as the spring member. A need exists for a way to electrically connect a flat terminal on the end of a power supply line with a generally coplanar bus bar on a PDB without the use of tools, threaded or specially designed posts, and separable components.

SUMMARY OF THE INVENTION

Accordingly, it is an object of this invention to enable an electrical connection to be made between a power supply cable and a planar contact from a power distribution box (PDB) without the use of threaded elements and a wrench or other tools.

Another object of the invention is to provide a self-locking lever for pressing a flat electrical terminal into electrical connection with a bus bar from the PDB.

A further object of the invention is to use a resiliency of the bus bar to facilitate the connection and eliminate the need for additional components.

In carrying out this invention in the illustrative embodiment thereof, a resilient bus bar extends from the electrical distribution system within a PDB. The bus bar has a deflectable or bowed section where it passes through a bracket. A lever arm with a cam element is pivotally mounted on the bracket above the bowed section of the bus bar. The cam element has a convexly rounded side, a substantially flat side, and a changeover edge between the rounded and flat sides. A pin extends upward from the PDB adjacent the bowed section of the bus bar. A secondary latch for receiving the lever arm extends upward from the PDB at a location spaced from the bracket.

In the connection process, a flat terminal with an aperture, crimped or otherwise attached on the end of a power supply cable, is placed over the pin onto the bowed section of the bus bar. The lever arm is pivoted toward the secondary lock, bringing the rounded side of the cam element into contact with the flat terminal. Continued rotation of the lever causes the rounded side of the cam element to force the terminal downward, flattening the bus bar, until the changeover edge of the cam element passes over the terminal. The flat side of the cam element then comes into contact with the terminal, maintaining the contact between the terminal and bus bar while holding the lever arm in the locked position. Simultaneously, the lever arm is received in the secondary latch and securely held there.

To release the terminal from electrical connection with the bus bar, enough force on the lever arm must be applied to overcome the secondary lock and force the changeover edge of the cam element back past the terminal. The bus bar returns to its bowed condition and, after the cam element separates from the terminal, the terminal can be lifted off the pin.

The connector assembly does not require a tool for operation. There are no loose parts to misplace or drop, and no threaded elements to strip or break. Factory returns and warranty issues would be reduced. The self-locking feature provided by the flat side of the cam element and the secondary latch for the lever arm both ensure a reliable electrical connection without danger of accidental release. The lever operation enables a relatively low connection force.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENT

Figure 1:
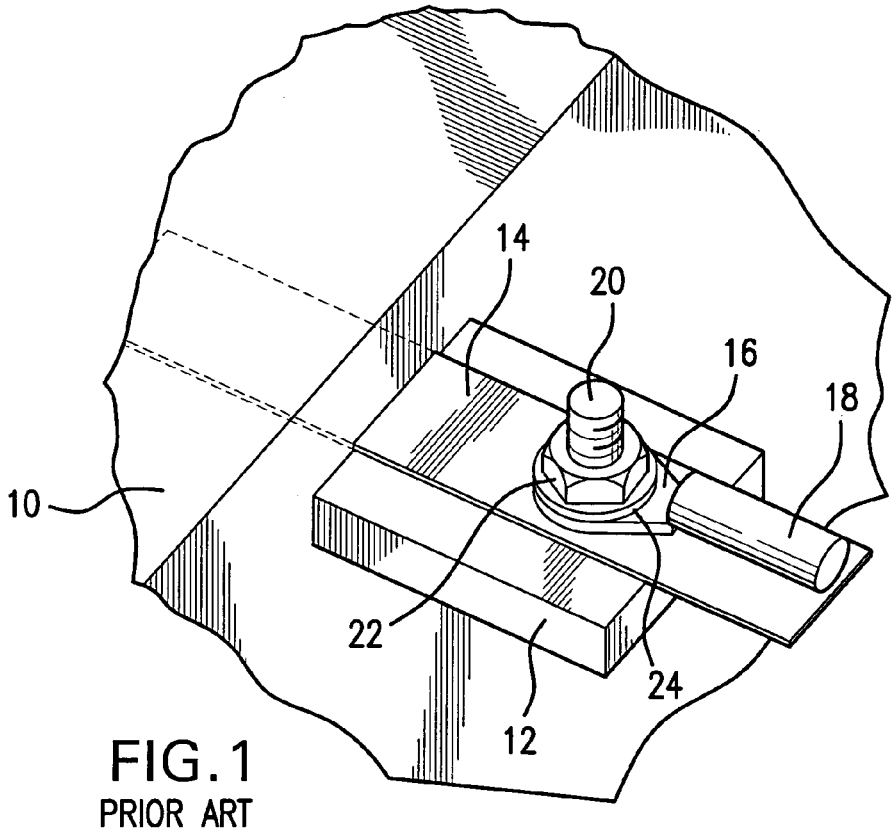
FIG. 1 PRIOR ART
FIG. 1 is a perspective view of a conventional electrical connection between a battery terminal and a power distribution box.
Figure 2:
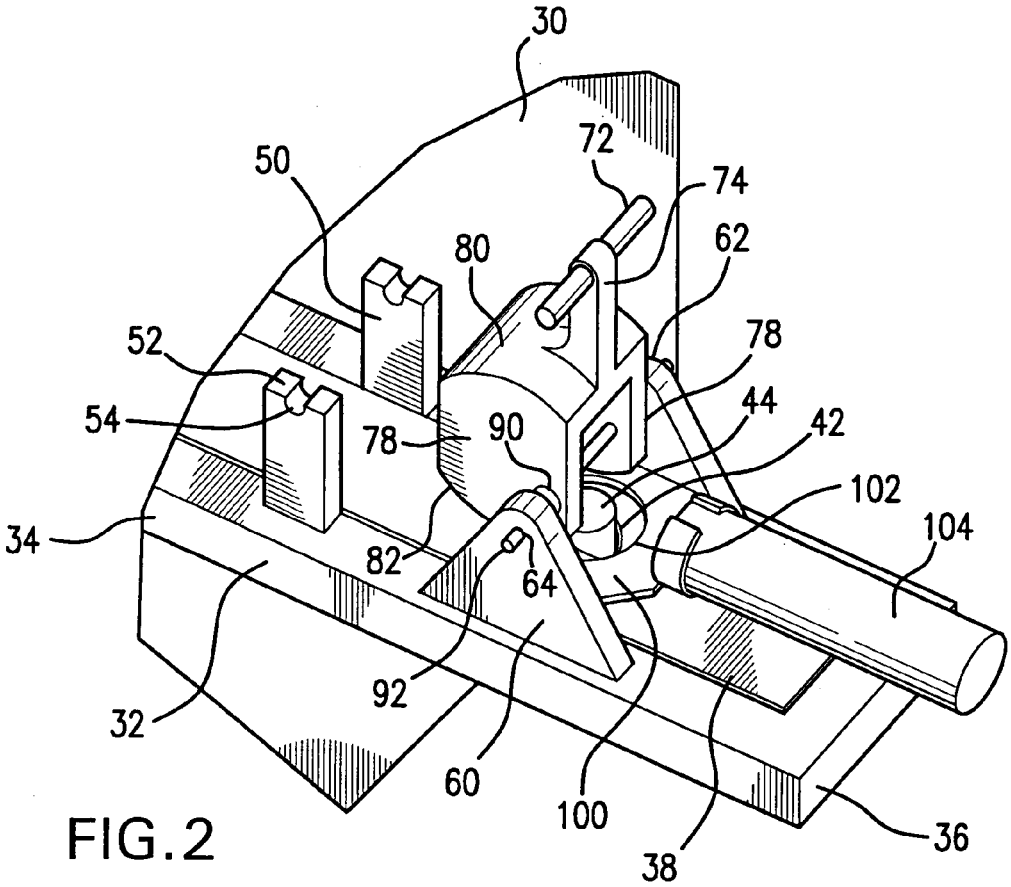
FIG. 2 is a perspective view of a connector assembly according to the present invention for electrically securing a terminated power supply cable to a power distribution box.
Figure 3:
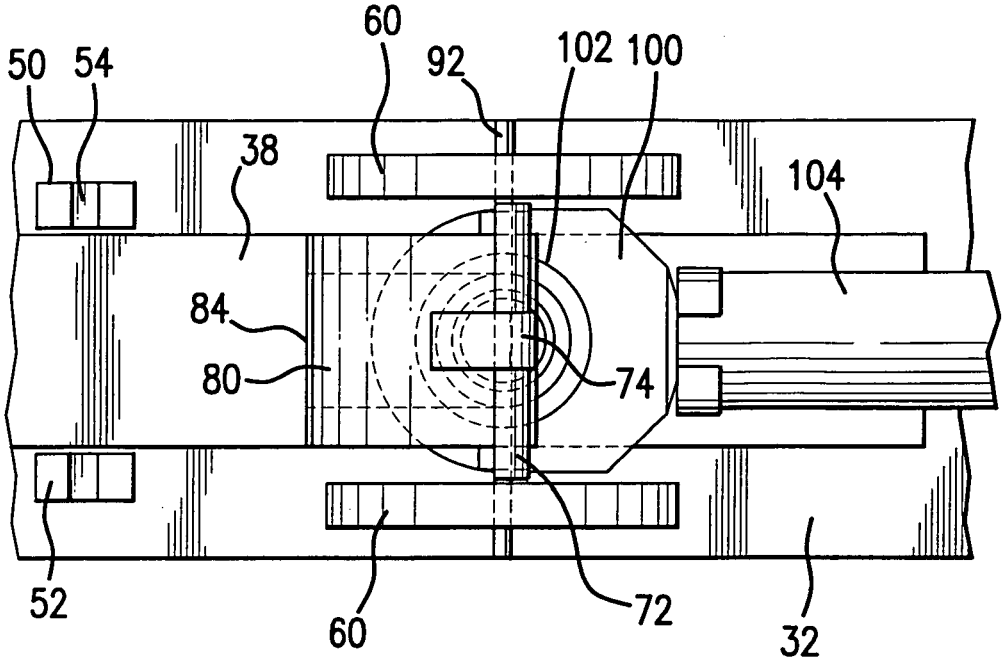
FIG. 3 is a top view of the connector assembly in an initial, unsecured position.
Figure 4:
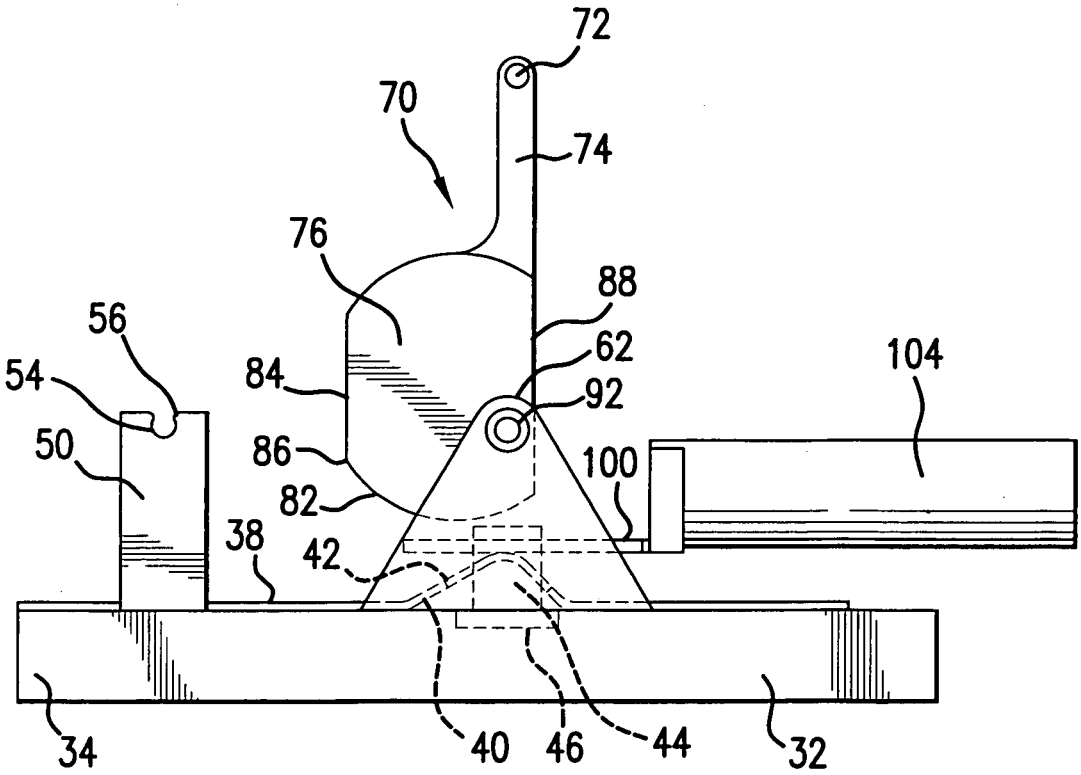
FIG. 4 is a side view of the connector assembly in the initial position.
Figure 5:
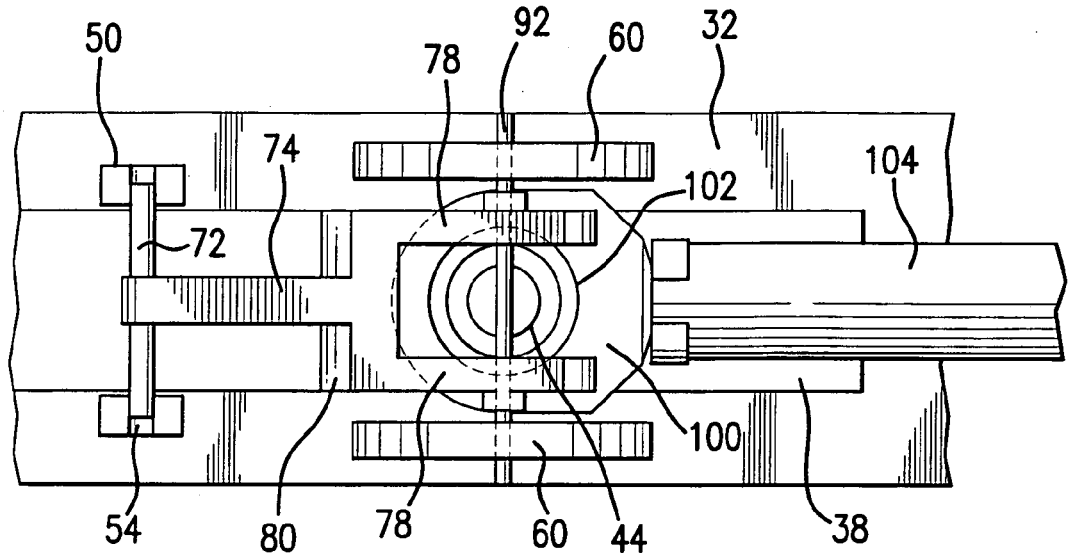
FIG. 5 is a top view of the connector assembly in an electrically connected, locked arrangement or position.

Referring now to FIGS. 2–4, a vehicle power distribution box (PDB) or module 30, only broadly represented, has an integral, protruding ledge 32 with a first end 34 adjacent the PDB and a second, free end 36 distal from the PDB. The PDB casing, and the integral ledge, can be injection molded, for example, from an electrically non-conductive thermoplastic. Alternatively, the ledge could be separately attached to the PDB, or could be eliminated and replaced by a non-conductive surface positioned someplace under a PDB cover.

A narrow plate or bus bar 38, manufactured from an electrically conductive, resilient metal, is supported on the ledge 32. The bus bar 38 extends back into the PDB for electrical connection with an internal power distribution system within the PDB. A securing device or connector assembly according to the present invention includes features of the bus bar 38 and ledge 32. The bus bar lies substantially flat on the ledge except for an intermediate raised or bowed section 40, best shown in FIG. 4, located approximately at a mid-part of the ledge. The bowed section 40 has a lengthwise, elongated aperture 42.

The ledge 32 has a relatively short, un-threaded cylindrical protrusion or pin 44 projecting upward from the ledge through the elongated aperture 42 of the bowed section 40 of the bus bar 38. The pin is made of an electrically non-conductive material and could be separately attached to the ledge 32 through a wider base 46 and an accommodating attribute (not shown) in the ledge. Alternatively, the pin could be an integrally molded part of the ledge. In addition, the pin doesn't necessarily have to extend through an aperture in the bus bar as depicted. It just needs to be near enough to the bus bar to guide the terminal into contact with the bowed section 40.

Back along the ledge toward the PDB, two latch projections 50 extend upward from the ledge 32 adjacent the first end 34 of the ledge. A top side 52 of each latch projection 50 has a tubular slot 54 with an entrance neck 56 narrower than an inside diameter of the slot. The slots 54 align across the ledge over the bus bar 38.

Two brackets or lever supports 60 also extend upward from the ledge 32. The supports 60 are located between the latch projections 50 and the free end 36 of the ledge. The supports 60 face each other across the bowed section 40 of the bus bar 38, and are triangular-shaped with apexes 62 at their maximum heights. The apexes 62 have small through-holes 64 aligned across the bowed section 40 of the bus bar and pin 44. The latch projections 50 and the lever supports 60 can be, for example, injection molded as part of the PDB ledge 32. They may optionally be separate, non-conductive components designed for attachment to the ledge.

A lever 70 is mounted on the supports 60. The lever 70 is manufactured from an electrically non-conductive material and is T-shaped with a relatively narrow cylindrical cross element 72 extending from each side of a first, free end of an arm 74. The outside diameter of the cross element 72 is substantially the same as the inside diameter of the tubular slots 54 in the latch projections 50. The lever arm 74 has a second end integral with or attached to a cam portion 76. The cam portion 76 is illustrated as being generally u-shaped with two leg segments 78 and a bridge segment 80 connecting the leg segments. The lever arm 74 extends from a central part of the bridge segment 80. Each leg segment 78 forms a separate cam and has a perimeter with three sides or sections. A first, rounded contact section 82 and a second, straight or flat contact section 84 are separated by a transition or changeover edge 86. A third section 88 of the leg segment perimeter extends away from the rounded section 82 toward the bridge segment 80 and the lever 70 arm 74.

A through-hole 90 in each leg segment 78 is located adjacent the third section 88. The through-holes 90 are closer to where the third section 88 meets the first rounded section 82 than where the third section approaches the lever. To mount the lever 70 on the lever supports 60, a pivot shaft or rod 92 passes through the through-holes 90 in each leg segment 78 and the through-holes 64 in the apexes 62 of the supports 60. The rod may be internally spring-loaded to change its length for completing the assembly, may be inserted from one side of a support through the leg segments and other support and held in place by one or more cotter pins, may be designed to snap into position on the supports, or may complete the assembly in some other conventional manner.

Figure 6:
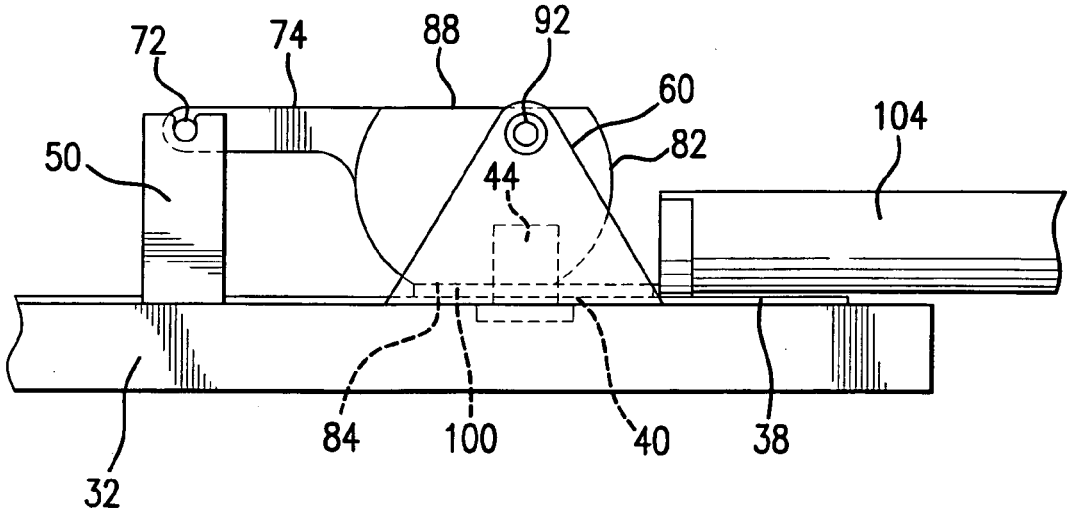
FIG. 6 is a side view of the connector assembly in the electrically connected, locked arrangement.

In operation of the connector assembly, the lever 70 is placed in an initial upright position as illustrated in FIGS. 2–4. A flat, metal eyelet terminal 100 having an aperture 102 and crimped or otherwise electrically attached to a conductive wire core within a power supply cable 104 from a battery or alternator, is fit over the pin 44 under the lever 70. This rests the eyelet terminal 100 on the bowed section 40 of the bus bar 38 and just under the rounded section 82 of the cam portion 76 of the lever. The leg segments 78 straddle the pin 44. It should be noted that it would be possible to use a cam portion having a single offset leg segment, rather than two spaced leg segments. However, the use of two leg segments provides a more balanced, stable device and steady operation. The general plane of the lever 70 is perpendicular to the substantially parallel planes of the electrical contact surfaces of the terminal 100 and bus bar 38. When force on the lever arm 74 rotates the lever 70 counterclockwise as oriented in the drawings, the rounded section 82 of the cam portion 76 of the lever 70 comes into contact with the eyelet terminal 100 and begins to push the terminal down on the bowed section 40 of the bus bar 38. Continued rotation of the lever progressively and substantially flattens the bowed section of the bus bar, as best shown in FIG. 6. The elongated size of the aperture 42 in the bowed section 40 of the bus bar allows this deflection relative to the pin 44.

After the changeover edge 86 of the cam portion passes the terminal surface, the flat section 84 of the cam portion engages the terminal 100 in a stable manner and prevents inadvertent rotation of the lever back to the upright position. The position of the through-holes 90 in the cam portion leg segments 78 and the length of the lever arm 74 are set such that the cross element 72 of the lever 70 snaps into the slots 54 of the latch projections 50 through the narrower entrance necks 56 when the lever is in the final, full electrical connect position. This provides a secondary lock in the form of complimentary latching means on the lever and PDB ledge. The lever is held in the full electrical connect position to reinforce the stable position furnished by the flat sections 84 of the cams of the cam portion 76 pressing on the terminal 100.

To release the lever and break the electrical connection, a clockwise-directed rotational force is applied on the lever. The force must be large enough to overcome the latch projections 50 and move the changeover edge 86 of the cam portion back past the eyelet terminal contact surface, and move the rounded section 82 of the cam portion back into contact with the terminal. Then the lever is easily rotated further to separate the cam portion 76 from the eyelet terminal 100, whereby the terminal can be lifted off the pin 44 and bus bar 38. The resiliency of the bus bar 38 enables the section 40 to return to the at-rest, bowed condition.

The connector assembly according to the present invent thus provides a secure, releasable electrical engagement between a power supply cable and a PDB without the need for high connection force, tools, threaded elements, and loose, separable components.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. A securing device for electrically connecting a terminal on an end of a power supply cable to a vehicle power distribution module, the device comprising:

an electrically nonconductive surface associated with the module;

an electrically conductive plate supported on the nonconductive surface and electrically connected to a power distribution system of the module, the plate having a resilient section bowed outward from the surface;

a protrusion projecting from the surface adjacent the plate for guiding the terminal of the power supply cable into contact with the resilient section of the plate; and a support extending from the surface and a lever pivotally mounted on the support, the lever having a cam portion for positioning over the terminal and the resilient section of the plate, wherein pivoting the lever enables the cam portion to press and hold the terminal against the resilient section of the plate.

2. The securing device of claim 1 wherein the cam portion has a first, rounded side configured for progressively pressing the terminal against the resilient section of the plate as the resilient section deflects toward the nonconductive surface.

3. The securing device of claim 2 further comprising a second side of the cam portion adjacent the rounded side for locking the lever in a position pressing the terminal against the plate and deflecting the resilient section.

4. The securing device of claim 3 wherein the second side of the cam portion is flat.

5. The securing device of claim 1 further comprising complimentary latching means on the lever and module for locking the device in a position electrically connecting the terminal to the module.

6. The securing device of claim 1 wherein the cam portion includes two leg segments connected by a bridge segment.

7. The securing device of claim 6 further comprising an operating arm extending from the bridge segment.

8. The securing device of claim 6 further comprising holes extending through each leg segment and through the support, the holes in the leg segments and support being aligned to receive a rod for enabling the lever to pivot relative to the support.

9. A connector for securing a terminal of an electrical wire to a resiliently biased electrical conductor supported on the connector, the connector comprising:

at least one cam, the at least one cam having a rounded section leading to a flat section, the rounded section and flat section being separated by a changeover edge; and means for pivotally mounting the at least one cam at least partially over the resiliently biased conductor;

wherein the rounded section of the at least one cam is configured to press the terminal against the resilient bias of the conductor when the terminal is placed between the at least one cam and conductor and the at least one cam is pivoted, and the flat section is configured to hold the at least one cam in a position pressing the terminal against the conductor after the changeover edge passes the terminal.

10. The connector of claim 9 wherein planes of the terminal and conductor are substantially parallel when the terminal is placed between the at least one cam and the conductor, and a plane of the at least one cam is perpendicular to the substantially parallel planes.

11. The connector of claim 9 further comprising a lever connected to the at least one cam for pivoting the at least one cam.

12. The connector of claim 11 further comprising latch means on the connector for holding the lever in a position where the flat section presses the terminal against the conductor.

13. The connector of claim 11 wherein there are two cams, each joined to the lever by a bridge section extending between the cams.

14. The connector of claim 9 further comprising an electrically non-conductive surface for supporting the resiliently biased conductor.

15. The connector of claim 14 wherein part of the conductor is bowed away from the non-conductive surface, providing the resilient bias of the conductor.

16. A connector for securing a terminal of an electrical wire to a resiliently biased electrical conductor supported on the connector, the connector comprising:

an electrically non-conductive surface for supporting the resiliently biased conductor;

at least one cam, the at least one cam having a rounded section leading to a relatively flat section;

means for pivotally mounting the at least one cam at least partially over the resiliently biased conductor; and a protrusion extending from the nonconductive surface, the protrusion being located to guide the terminal into a proper position between the at least one cam and the conductor;

wherein the rounded section of the at least one cam is configured to press the terminal against the resilient bias of the conductor when the terminal is placed between the at least one cam and conductor and the at least one cam is pivoted, and the relatively flat section is configured to hold the at least one cam in a position pressing the terminal against the conductor.

17. The connector of claim 16 wherein the protrusion is cylindrical and sized to be received in an aperture of the terminal.

* * * * *